US009115459B2

(12) United States Patent
Chanda et al.

(10) Patent No.: US 9,115,459 B2
(45) Date of Patent: Aug. 25, 2015

(54) LAUNDRY TREATING APPLIANCE WITH AUTOMATIC PUMP SHUTOFF

(71) Applicant: Whirlpool Corporation, Benton Harbor, MI (US)

(72) Inventors: Hirak Chanda, Troy, MI (US); Michael L. Jackmeyer, Buchanan, MI (US); James A. Oskins, Saint Joseph, MI (US); Jon D. Strait, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/318,791

(22) Filed: Jun. 30, 2014

(65) Prior Publication Data

US 2014/0311192 A1 Oct. 23, 2014

Related U.S. Application Data

(62) Division of application No. 12/791,172, filed on Jun. 1, 2010, now Pat. No. 8,793,828.

(60) Provisional application No. 61/323,405, filed on Apr. 13, 2010.

(51) Int. Cl.
*D06F 33/02* (2006.01)
*D06F 39/08* (2006.01)

(52) U.S. Cl.
CPC ..... *D06F 39/085* (2013.01); *D06F 33/02* (2013.01); *D06F 2202/085* (2013.01); *D06F 2202/12* (2013.01); *D06F 2204/084* (2013.01)

(58) Field of Classification Search
None
See application file for complete search history.

(56) References Cited

U.S. PATENT DOCUMENTS

2008/0263783 A1* 10/2008 Pyo ..... 8/149.3

FOREIGN PATENT DOCUMENTS

GB 2274343 A * 7/1994

* cited by examiner

*Primary Examiner* — Jason Ko

(57) ABSTRACT

A laundry treating appliance having a pump, such as a drain pump, with an automatic shutoff, and a method for controlling the shut off of the pump.

8 Claims, 5 Drawing Sheets

LAUNDRY TREATING APPLIANCE WITH AUTOMATIC PUMP SHUTOFF

CROSS-REFERENCE TO RELATED APPLICATIONS

The present application is divisional application of U.S. patent application Ser. No. 12/791,172 filed Jun. 1, 2010, entitled "Laundry Treatment Appliance with Automatic Pump Shutoff", currently allowed, which application claims the benefit of U.S. Provisional Patent Application No. 61/323,405 entitled "Laundry Treating Appliance with Automatic Pump Shutoff" filed Apr. 13, 2010, both herein incorporated by reference in their entirety.

Laundry treating appliances, such as clothes washing machines, that use liquids typically provide for the removal of the liquid during one or more parts of a treating cycle of operation. A pump may be used to remove the liquid. In the case of a clothes washer, a drain pump in a sump portion of a wash tub pumps the liquid from the sump to a household drain.

An operational concern with most liquid pumps is that the pump can only be operated when there is sufficient liquid to satisfy the pump, which prevents undesirable noise generated when a liquid pump is pumping substantial amounts of air and also reduces the likelihood of damaging the motor of the pump.

BRIEF DESCRIPTION OF THE INVENTION

In one aspect, the invention relates to a laundry treating appliance for treating laundry according to a cycle of operation. The appliance comprises a treating chamber configured to receive the laundry for treatment, a dispensing system fluidly coupled to the treating chamber and configured to dispense at least one treating chemistry to the treating chamber, a drain pump fluidly coupled to the treating chamber to drain the treating chemistry from the treating chamber, and a controller operably coupled to the drain pump and configured to turn off the drain pump when the change in electrical current supplied to the drain pump satisfies a first threshold and the change in the electrical voltage supplied to the drain pump satisfies a second threshold.

DESCRIPTION OF AN EMBODIMENT OF THE INVENTION

Figure 1:
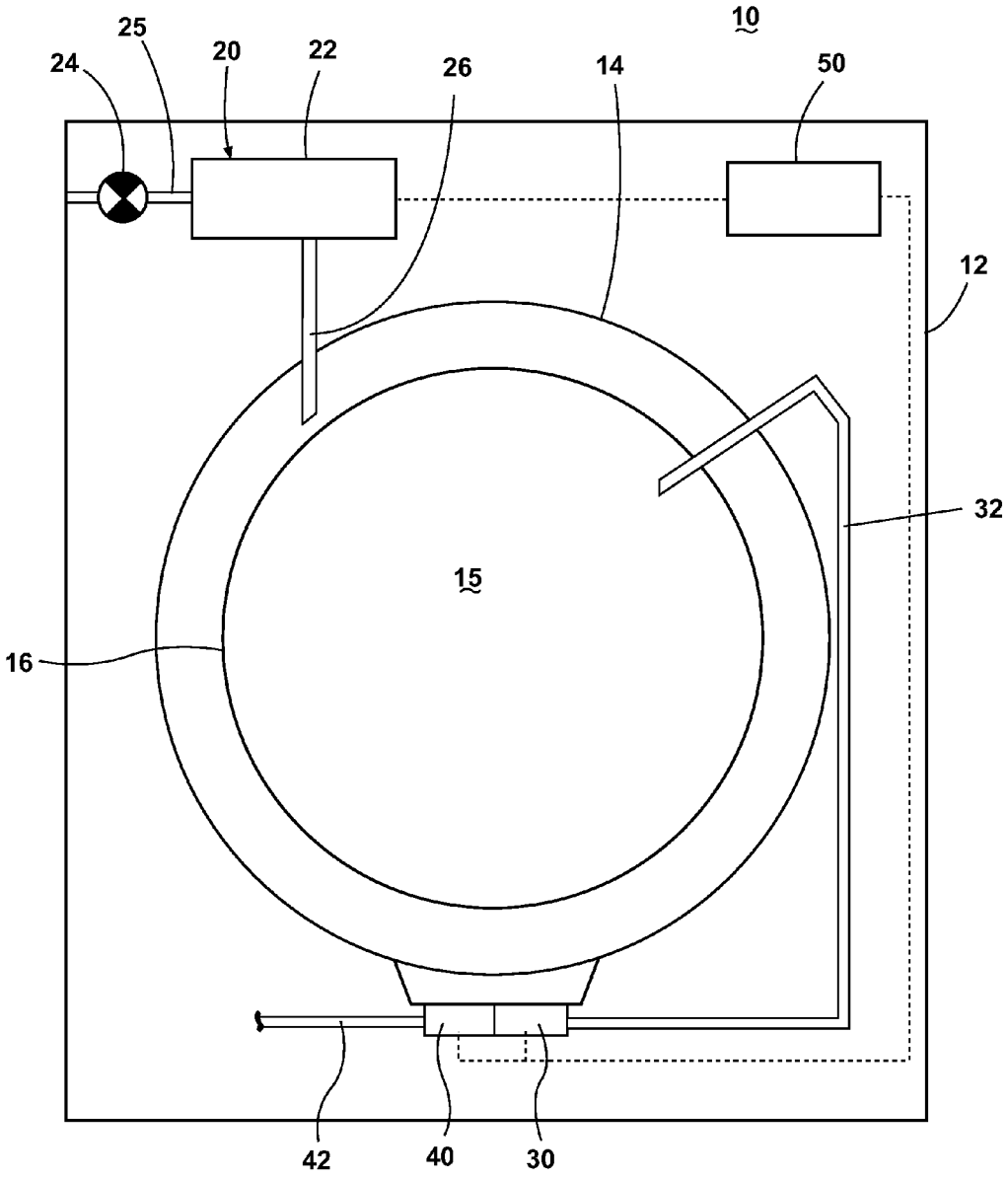
FIG. 1 is a schematic illustration of a laundry treating appliance according to a first embodiment of the invention.

FIG. 1 schematically illustrates a first embodiment of the invention in the environment of a laundry treating appliance in the form of a horizontal-axis clothes washer 10 comprising a housing 12, which may be a cabinet, chassis, or both, defining an interior. A tub 14 may be provided in the interior of the housing 12 and may be configured to hold liquid. The tub 14 may be supported within the housing 12 by a suitable suspension system.

A drum 16 may be provided within the tub 14 and defines a treating chamber 15 for receiving laundry to be treated according to a cycle of operation. The drum 16 may be mounted for rotation within the tub 14. The drum 14 may have perforations that permit the flow of water between the drum 16 and the tub 14.

The tub 14 and drum 16 may have aligned openings that provide access to the treating chamber 15. A door (not shown) may be provided to selectively close at least one of the aligned openings to selectively provide access to the treating chamber 15.

A treating chemistry dispensing system 20 may be provided within the housing 12 and comprises a treating chemistry reservoir 22 in which one or more treating chemistries may be provided in any desirable configuration, such as a single charge, multiple charge (also known as bulk dispenser), or both. Examples of typical treating chemistries include, without limitation, water, detergent, bleach, fabric softener, and enzymes. The treating chemistry dispensing system 20 may be configured to meter the treating chemistry as required for a particular cycle of operation.

Water may be supplied from a water source, such as a household water supply, to the treating chemistry reservoir 22 by operation of a valve 24 controlling the flow of water through an inlet conduit 25. An outlet conduit 26 extends from the treating chemistry reservoir 22 to the tub 14. Thus, any treating chemistry supplied from the treating chemistry reservoir 22 may be supplied to the tub 14 via the outlet conduit 26.

If it is desired to just supply water to the tub 14, the water from the household supply may pass from the inlet conduit 25, through the treating chemistry reservoir 22, through the outlet conduit 26 to the tub 14, without the mixing of any additional treating chemistry. However, one or more treating chemistries may be dispensed from the treating chemistry reservoir 22 and the water from the source may be supplied via the inlet conduit 25 to flush the treating chemistries from the treating chemistry reservoir 22, through the outlet conduit 26, and into the tub. This technique is useful when the treating chemistry reservoir 22 is a drawer having one or more reservoirs holding treating chemistry and the reservoirs are flushed to dispense the treating chemistry in the reservoirs. Alternatively, the water may be used to control the concentration of the treating chemistry as part of or independent of the flushing.

A liquid recirculation system may be provided for recirculating liquid to the treating chamber 15. As illustrated, the recirculation system comprises a recirculation pump 30 and a spray conduit 32. The recirculation pump 30 fluidly couples the tub 14 to the spray conduit 32 such that liquid in the tub 14 may be supplied to the spray conduit 32, where it is sprayed into the treating chamber 15. The recirculation pump 30 may be located in a low portion or sump of the tub 14.

A liquid drain system may be provided for draining liquid from the treating chamber 15. The liquid draining system comprises a drain pump 40 and a drain conduit 42. The drain pump 40 fluidly couples the tub 14 to the drain conduit 42 such that liquid in the tub 14 may be drained via the drain conduit 42. The drain conduit 42 may be coupled to a household drain. The drain pump 40 may be located in a low portion or sump of the tub 14.

A controller 50 may be provided for controlling the operation of the various components of the laundry treating appliance 10 to implement one or more cycles of operation, which may be stored in a memory of the controller 50. Examples, without limitation, of cycles of operation may include: wash, heavy duty wash, delicate wash, quick wash, refresh, rinse only, and timed wash. Any suitable controller 50 may be used. The specific type of controller is not germane to the invention. It is contemplated that the controller 50 may be a microprocessor-based controller that implements control software and sends/receives one or more electrical signals to/from each of the various components to effect the control software. As an example, proportional control (P), proportional integral control (PI), and proportional derivative control (PD), or a combination thereof, a proportional integral derivative control (PID control), may be used to control the various components.

The controller 50 may be operably coupled to at least the treating chemistry dispensing system 20, valve 24, recirculation pump 30, drain pump 40, and a motor (not shown) that rotates the drum 16 to control the operation of these and other components to implement one or more of the cycles of operation. The recirculation pump 30 and drain pump 40 may each have a motor that drives the pump that provides operational data to the controller 50. For example, motor speed, electrical current, electrical voltage, and other data may be provided by the motor of the circulation pump 30 or drain pump 40. Such operational data may also be supplied by the motor that rotates the drum 16. Alternatively, separate sensors may be provided to sense the operation data and provide it to the controller 50 independent of the motors.

Figure 2:
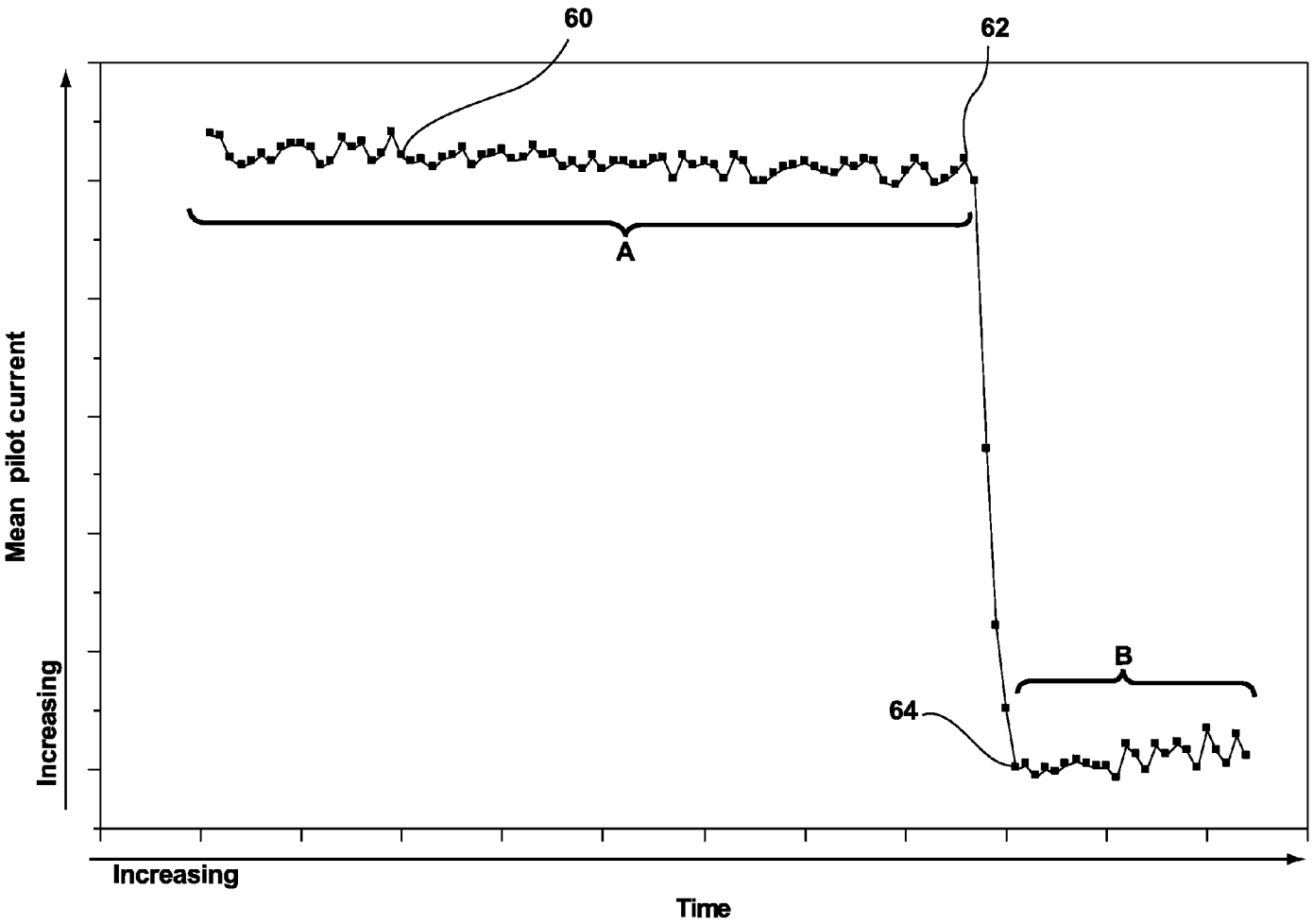
FIG. 2 is a plot of the electrical current supplied to a drain pump of the laundry treating appliance of claim 1 while the pump transitions from a satisfied state to a non-satisfied state.

FIG. 2 illustrates the electrical current 60 drawn by the drain pump 40 during a draining operation of the drain pump 40. The "mean pilot current" in FIG. 2 may be defined as raw pilot current that may be filtered by a suitable software or hardware. The plot begins by showing the electrical current draw when the drain pump 40 is satisfied with liquid; that is, the drain pump 40 is pumping mostly liquid. It is at this time that the power requirements of the drain pump 40 are greatest because of the force needed to move the volume of liquid. The electrical current draw during this period is illustrated by bracket A, satisfied state. It can be seen that the electrical current draw is "high" and relatively steady, subject to slight variations in the electrical current draw.

From the point denoted by numerals 62 to 64, the electrical current draw drops dramatically. This drop in electrical current is associated with the drain pump 40 no longer being satisfied by liquid and substantial amounts of air are being pumped. The reduction of liquid being pumped results in reduced power demand by the pump, which amounts to a corresponding drop in electrical current.

After the drop in electrical current from points 62 to 64, the electrical current draw continues at a relatively "low" level because the drain pump 40 continues to be non-satisfied and pumps substantial amounts of air, which requires much less power than pumping water. The electrical current draw during this non-satisfied state is denoted by the bracket B, non-satisfied state. Thus, the drop in electrical current is representative of a change in state of the drain pump from a satisfied state to a non-satisfied state.

The electrical current draw may be used by the controller 50 to determine when to shut off the drain pump 40 when there is insufficient liquid to satisfy the drain pump 40. When the non-satisfied state exists, the controller 50 may shut off the drain pump 40 for a predetermined time or other criteria and then turn it on again. As can be seen in FIG. 2, while there is some operational variation in the electrical current draw 60 in each of the bracket A and B, the change in the electrical current draw related to the change from satisfied to non-satisfied state, illustrated by the current drop between points 62 and 64, is much greater than the operational variation of the electrical current draw 60 in each of the bracket A and B. Thus, it is possible to select a threshold change value that is sufficient to differentiate between an operational change and a state change.

It should be noted that the data in FIG. 2 represents idealized conditions, which are not consistently present during a cycle of operation. These non-idealized conditions may lead to drops in the electrical current draw that could lead to a false or premature conclusion that the draining phase is completed and the pump could be shut off when it is not necessary or desirable to do so. One source of temporary electrical current drop may occur during an extraction or spin phase of a treating cycle of operation, where liquid is extracted from the laundry by accelerating the drum 16 during an acceleration phase to a relatively high spin speed for a steady state spin phase. During the extraction phase, the rate of liquid extraction is not consistent. There may be times where the rate of liquid extraction may be temporarily insufficient to satisfy the pump, resulting in a temporary drop in the electrical current similar to that shown in FIG. 3, which is discussed in greater detail below. Another source is filtering and data sampling techniques that may generate an electrical current drop that is sufficient at times to appear like a state change instead of an operational change.

To avoid false or premature conclusions that a state change has occurred, it has been found that the change in electrical voltage may also be considered in combination with the change in electrical current to render a more accurate determination of a state change. Here the electrical voltage may be defined as any voltage provided to the laundry treating appliance from any suitable power source including a line voltage. By viewing both the change in electrical voltage and the change in electrical current, insight may be gained into the cause of power drop.

For example, both the electrical voltage and the electrical current may be constantly monitored, and the change in electrical voltage may be calculated along with the change in electrical current. If the change in electrical voltage is above a predetermined threshold, then the change in electrical current is ignored regardless of the threshold. Alternatively if the change in electrical current exceeds the predetermined threshold while the change in electrical voltage is below the threshold or not measured, it is concluded that state change has occurred. Thus, it is possible to verify that the electrical current changes do indicate a state change by also looking at the change in electrical voltage. Therefore, an electrical voltage change threshold may be selected and tested in combination with the electrical current change threshold to improve the determination of the state change.

In one implementation, the electrical voltage change threshold and the electrical current change thresholds may be selected as an upper limit, absolute values. When the change in electrical current exceeds the electrical current threshold and the change in the electrical voltage subceeds (does not exceed) the electrical voltage change threshold, it is determined that a state change has occurred and the drain pump 40 is shut off.

As with all thresholds, it may be possible to mathematically arrange them as upper or lower limits, which may be satisfied/non-satisfied by exceeding, meeting, or subceeding the threshold. For purposes of this description, a threshold will be referred to as being satisfied when the corresponding condition for the threshold is met, with it being understood that the threshold, depending on how it is mathematically arranged, could be exceeded, met, or subceeded by the actual value.

Figure 3:
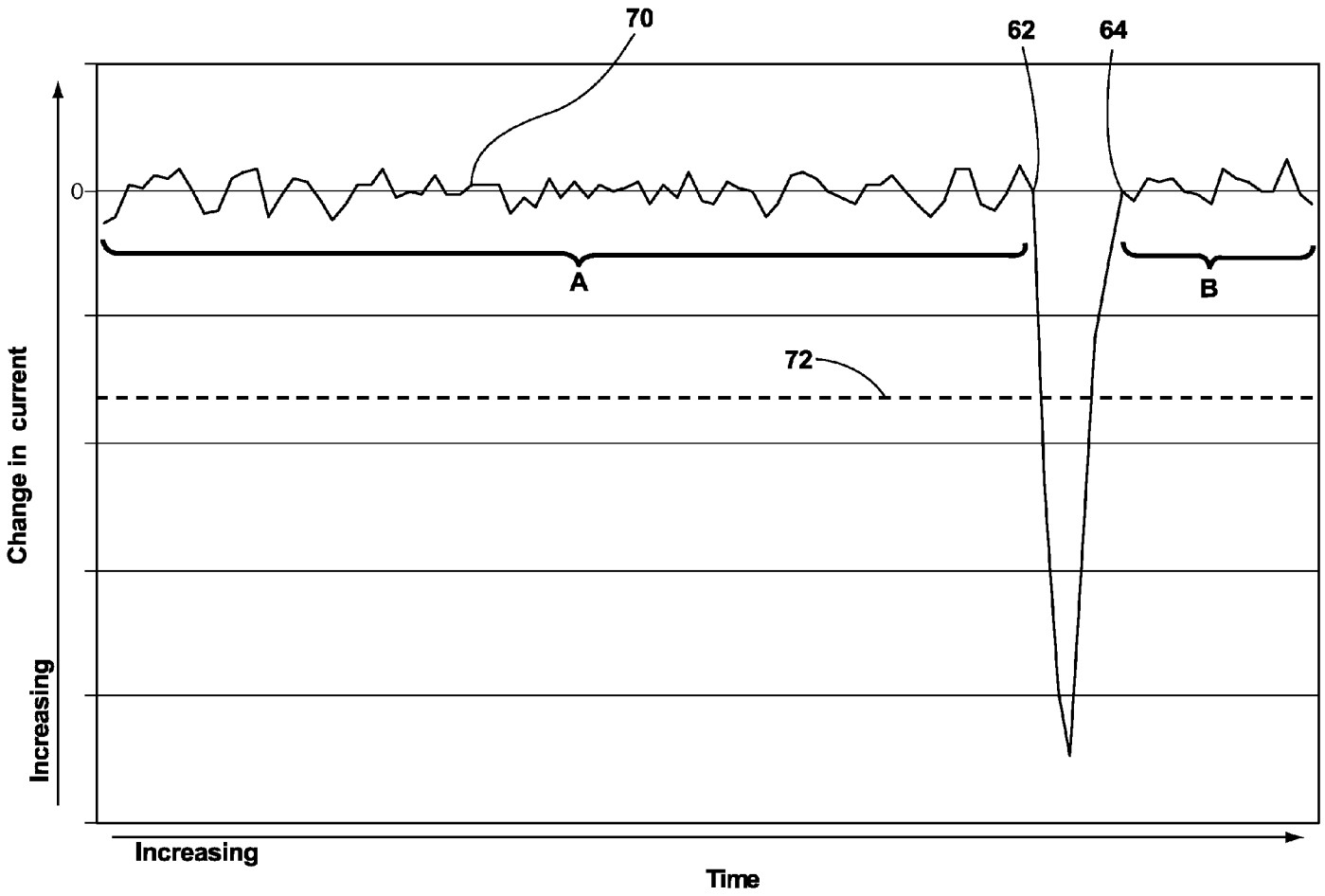
FIG. 3 is a plot of the change over time of the electrical current supplied to the drain pump of the laundry treating appliance of claim 1 while the pump transitions from a satisfied state to a non-satisfied state.

FIG. 3 is an illustrative plot of the change in the electrical current over time 70 of the electrical current data 60 from FIG. 2 relative to a threshold value identified by numeral 72. The change may be determined by a simple difference method calculated by subtracting the current electrical current data point from the prior data point, although other mathematical approaches for differences may be used, non-limiting examples of which include calculating a moving average and a derivative. The change in the electrical current over time varies about the zero point for the satisfied state A and the non-satisfied state B, with an intervening drop below the threshold value as the drain pump 40 changes state. If the corresponding electrical voltage difference subceeds the electrical voltage threshold, then the state change would be verified, and the drain pump would be shut off.

It has been found that the change in electrical current during the state change is three to four times greater than the change in electrical current due to the noise in electrical voltage.

Figure 4:
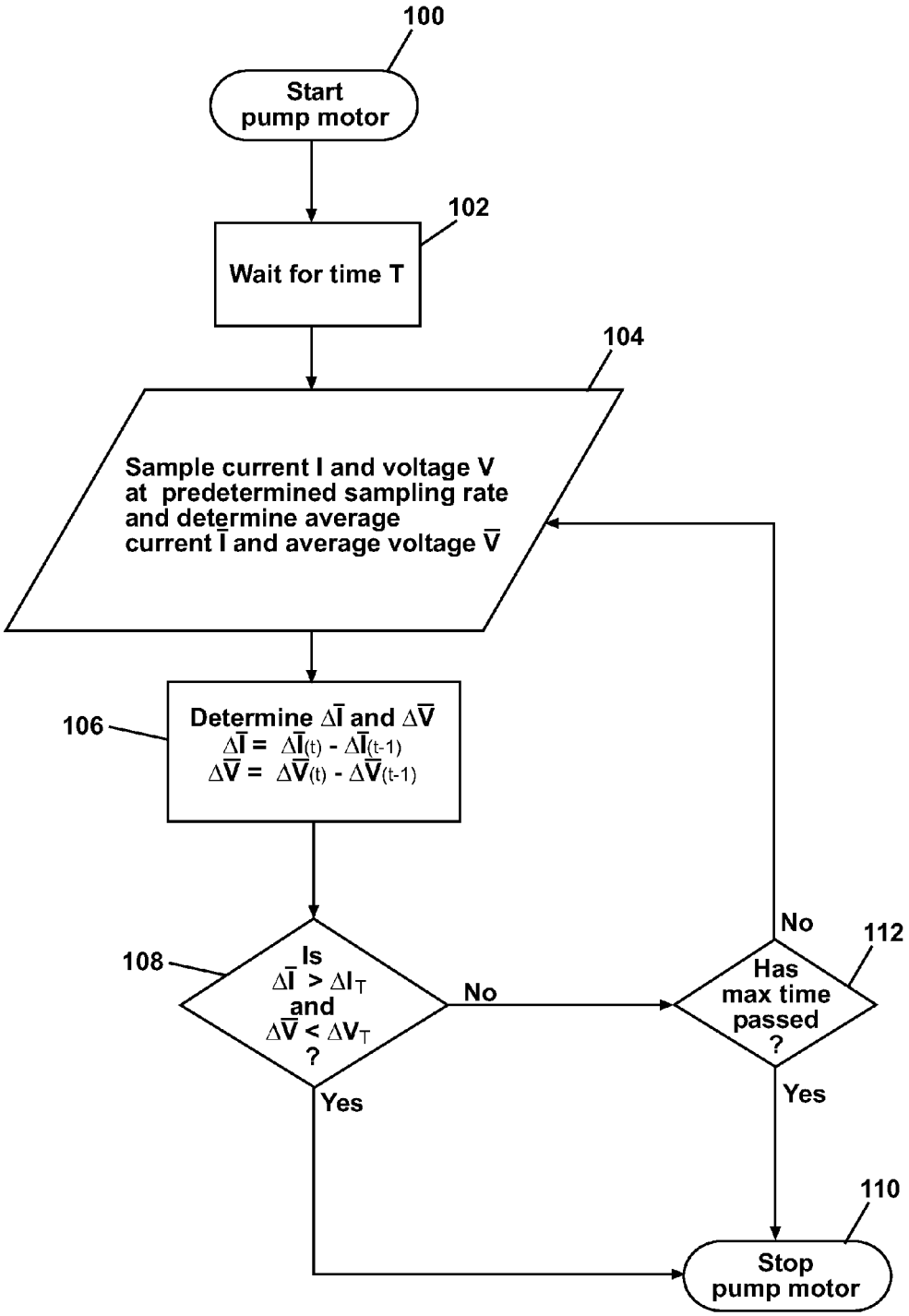
FIG. 4 is a flow chart illustrating a method of controlling the drain pump of FIG. 1 according to another embodiment of the invention.

FIG. 4 is a flow chart illustrating a control method for the drain pump 40 according to another embodiment of the invention. The method begins at 100 with the drain pump 40 being activated or turned on. A predetermined time period T may be permitted to pass at 102 before which a plurality of electrical current, I, and electrical voltage, V, values are taken at a predetermined sampling rate at 104. The plurality of electrical current, I, and electrical voltage, V, values are then averaged $\bar{I}$, $\bar{V}$ and the averages stored. The difference may then be determined between the most recent determined averages, say, for example at time t, for electrical current and electrical voltage and a previously determined average, say, for example, at time t−1, for electrical current and electrical voltage at 106 to calculate an electrical current change $\Delta\bar{I}$ and electrical voltage change $\Delta\bar{V}$, which are then tested at 108 to determine if they satisfy the corresponding change threshold $\Delta I_T$ and $\Delta V_T$, respectively. If both the electrical current difference and electrical voltage difference satisfy their corresponding change threshold, then the motor may be stopped at 110. If not, then a safety time check may be made at 112 to determine if the motor has been ON for more than a predetermined max time. If the motor has been on for more than the predetermined max time, it may be assumed that an error has occurred and the motor may be stopped at 110. If the max time has not been exceeded, then the method returns to 104 where a new average electrical current and average electrical voltage may be determined. The process continues the method of looping through 104, 106, 108 and 112 until both the average change in electrical current and average change in electrical voltage satisfy their corresponding thresholds at 108 or until the max time is reached at 112.

It should be noted that while averages are calculated for the electrical current and electrical voltage values, it is not necessary to use averages. Non-averaged values may be used. Also, different average methods may be used such as a weighted average or a moving average. It is also possible to mix non-averaged and averaged data, such as by comparing the new actual data to an average, such as a running average. There are many methods that may be used and the illustrated methods should not be considered to limit the invention.

Additionally, the methods described herein may be used with any suitable laundry treating appliance. The laundry treating appliance may be any machine that treats articles such as clothing or fabrics, and examples of the laundry treating appliance may include, but are not limited to, a washing machine, including top-loading, front-loading, vertical-axis, and horizontal-axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

Figure 5:
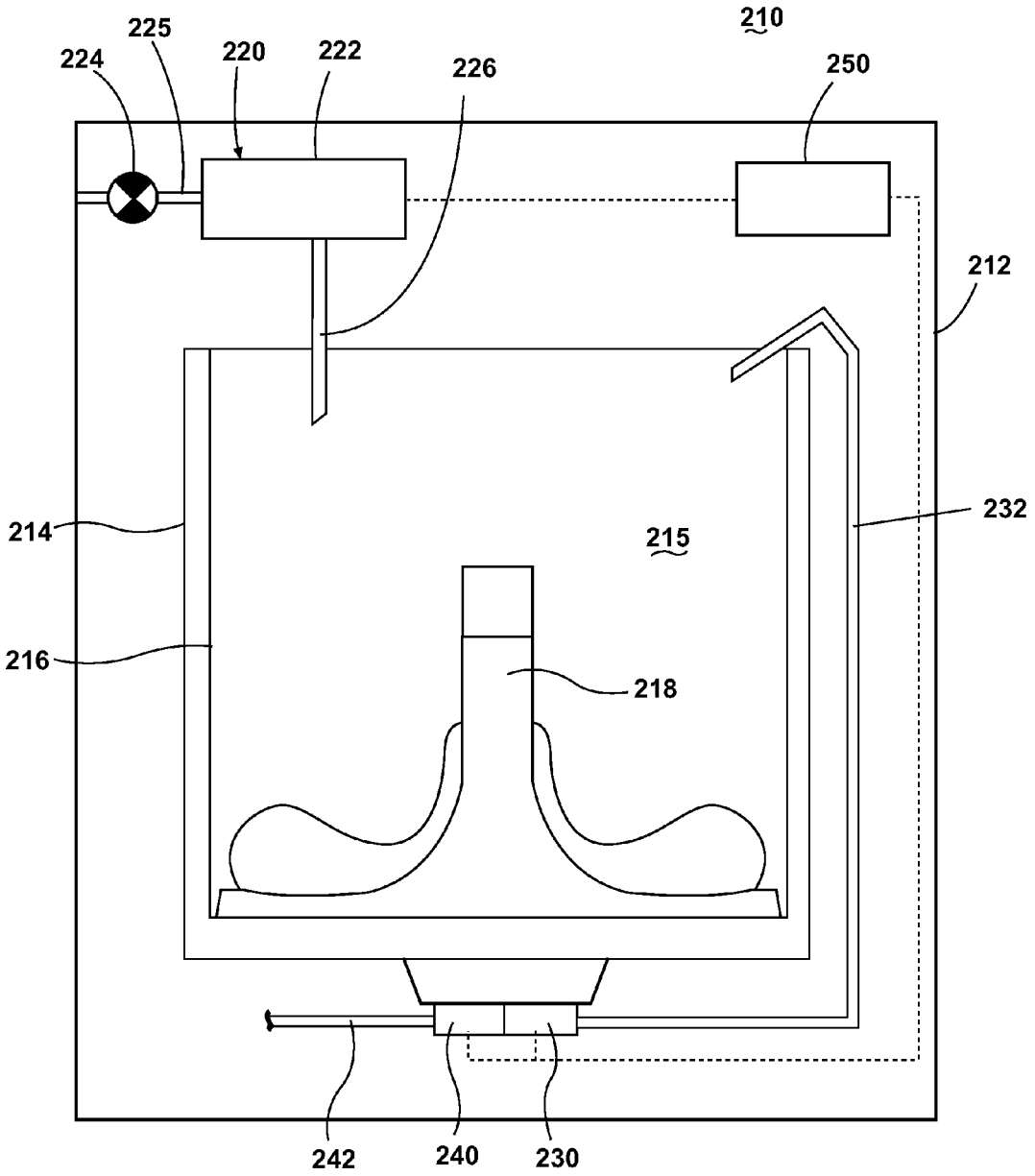
FIG. 5 is a schematic illustration of the laundry treating appliance according to another embodiment of the invention.

FIG. 5 schematically illustrates the laundry treating appliance according to another embodiment of the invention in the form of the vertical-axis clothes washing machine 210. The vertical axis washer 210 has many similar elements as the horizontal axis washer 10. Therefore, the similar elements will be identified by numerals preceded by 200, with it being understood that the prior description for the horizontal axis washing machine 10 applies to the similar elements.

The operation of the vertical-axis clothes washer machine 210 is the same as described above with respect to the horizontal-axis washing machine 10. That is, both the change in electrical current and the change in electrical voltage to the drain pump 240 are monitored during the operation of the drain pump 240. When change in electrical current and the change in electrical voltage satisfy their respective thresholds, the motor is in an unsatisfied state and it is shut off. The method as illustrated and described in FIG. 4 may be used to control the operation of the drain pump 240.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry according to a cycle of operation, comprising:

a treating chamber configured to receive the laundry for treatment;

a dispensing system fluidly coupled to the treating chamber and configured to dispense at least one treating chemistry to the treating chamber;

a drain pump fluidly coupled to the treating chamber to drain the treating chemistry from the treating chamber; and a controller operably coupled to the drain pump and configured to monitor over time the change in electrical current supplied to the drain pump and monitor over time the change in electrical voltage supplied to the drain pump, the change in the electrical voltage being contemporaneous with the change in the electrical current, and turn off the drain pump when the change in electrical current supplied to the drain pump satisfies a first threshold and the change in the electrical voltage supplied to the drain pump satisfies a second threshold.

2. The laundry treating appliance of claim 1 wherein the controller is further configured to monitor over time the change in the electrical current supplied to the drain pump while the drain pump is turned on, and monitor over time the change in the electrical voltage supplied to the drain pump while the drain pump is turned on.

3. The laundry treating appliance of claim 1 further comprising a rotatable drum defining the treating chamber.

4. The laundry treating appliance of claim 3 further comprising a tub in which the rotatable drum is received and the tub is fluidly coupled with the treating chamber.

5. The laundry treating appliance of claim 4 wherein the drum has a plurality of perforations to fluidly couple the treating chamber to the tub.

6. The laundry treating appliance of claim 4 wherein the drain pump is fluidly coupled to the tub to fluidly couple the pump to the treating chamber via the tub.

7. The laundry treating appliance of claim 1 further comprising an air flow system configured to supply air to the treating chamber.

8. The laundry treating appliance of claim 7 wherein the air flow system comprises a heating system that heats the air supplied to the treating chamber.

* * * * *